US006193552B1

(12) United States Patent
Chiou et al.

(10) Patent No.: US 6,193,552 B1
(45) Date of Patent: Feb. 27, 2001

(54) ELECTRICAL CONNECTOR

(75) Inventors: Song-Rong Chiou, Lin-Kou; Kun-Tsan Wu, Tu-Chen, both of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/273,939

(22) Filed: Mar. 22, 1999

(30) Foreign Application Priority Data

Mar. 21, 1998 (TW) ..... 87204255

(51) Int. Cl.[7] ..... H01R 13/648
(52) U.S. Cl. ..... 439/607
(58) Field of Search ..... 439/607, 608, 439/497, 492, 108, 954

(56) References Cited

U.S. PATENT DOCUMENTS 5,017,156 * 5/1991 Sugiyama ..... 439/607
5,073,130 * 12/1991 Nakamura ..... 439/607
5,267,875 * 12/1993 Koegel et al. ..... 439/497
5,725,386 * 3/1998 Davis et al. ..... 439/79
5,984,726 * 11/1999 Wu ..... 439/607

* cited by examiner

*Primary Examiner*—Lincoln Donovan
*Assistant Examiner*—Brian S. Webb
(74) *Attorney, Agent, or Firm*—Wei Te Chung

(57) ABSTRACT

An electrical connector comprises an insulative housing for receiving a plurality of contacts each of which comprises a contacting portion and a soldering tail. An intermediate plate is integrally formed in the insulative housing and defining a plurality of passageways for respectively receiving the contacting portion of the contact. A positioning device is connected to a section of each soldering tail of the contacts and retained in the housing so that a face of the positioning device is in contact with an edge of the intermediate plate. A metallic shielding encloses the insulative housing and defines two opposite entrances allowing the housing and the contacts to communicate with external.

11 Claims, 3 Drawing Sheets

ELECTRICAL CONNECTOR

BACKGROUND OF THE INVENTION

1. Field of the Invention

The present invention relates to an electrical connector, and particularly to an electrical connector which has well-retained soldering tails for soldering to a printed circuit board.

2. The Prior Art

Advanced electrical connectors, particularly high frequency electrical connectors, such as IEEE 1394 connectors, are covered with a corresponding shielding for suppression of noise during signal transmission. The shielding is further installed with a pair of positioning tabs for effectively positioning the connector onto a printed circuit board to have a stable soldering effect during a wave soldering procedure. Some related patents are U.S. Pat. Nos. 5,017,156, 5,073,130, and 5,266,038. However, the contacts of these connectors are not perfectly positioned in the housing thereof, therefore displacement of the contacts may happen during a soldering procedure thus adversely affecting the accuracy of the contacts' position.

SUMMARY OF THE INVENTION

The primary purpose of the present invention is to provide an improved electrical connector which can provide a relatively good positioning effect for the contacts received therein so that the contacts can remain in proper position during a soldering procedure or a mating engagement with a complementary connector.

Another purpose of the present invention is to provide an improved electrical connector having a shielding for suppressing noise and stand-off members extending from an insulative housing thereof preventing unwanted contact of the shielding to a printed circuit board on which the connector is mounted.

In accordance with one aspect of the present invention, an electrical connector comprises an insulative housing for receiving a plurality of contacts each of which comprises a contacting portion and a soldering tail. An intermediate plate is integrally formed in the insulative housing and defines a plurality of passageways for respectively receiving the contacting portion of the contact. A positioning device is connected to a section of each soldering tail of the contacts and retained in the housing so that a face of the positioning device is in contact with an edge of the intermediate plate. A metallic shielding encloses the insulative housing and defines two opposite entrances for communication of the insulative housing to outward.

In accordance with another aspect of the present invention, an electrical connector comprises an insulative housing for receiving a plurality of contacts each of which comprises a contacting portion and a soldering tail. The insulative housing has stand-off means extending from a periphery edge thereof. An intermediate plate is integrally formed in the insulative housing and defining a plurality of passageways for respectively receiving the contacting portion of the contact. A positioning device defines a plurality of recesses at opposite sides thereof for respectively retaining a section of each soldering tail of the contacts and the positioning board is retained in the housing so that a face of the positioning device is in contact with an edge of the intermediate plate. A metallic shielding encloses the insulative housing and defines two opposite entrances for communication of the insulative housing to external.

DETAILED DESCRIPTION OF THE PREFERRED EMBODIMENT

Figure 1:
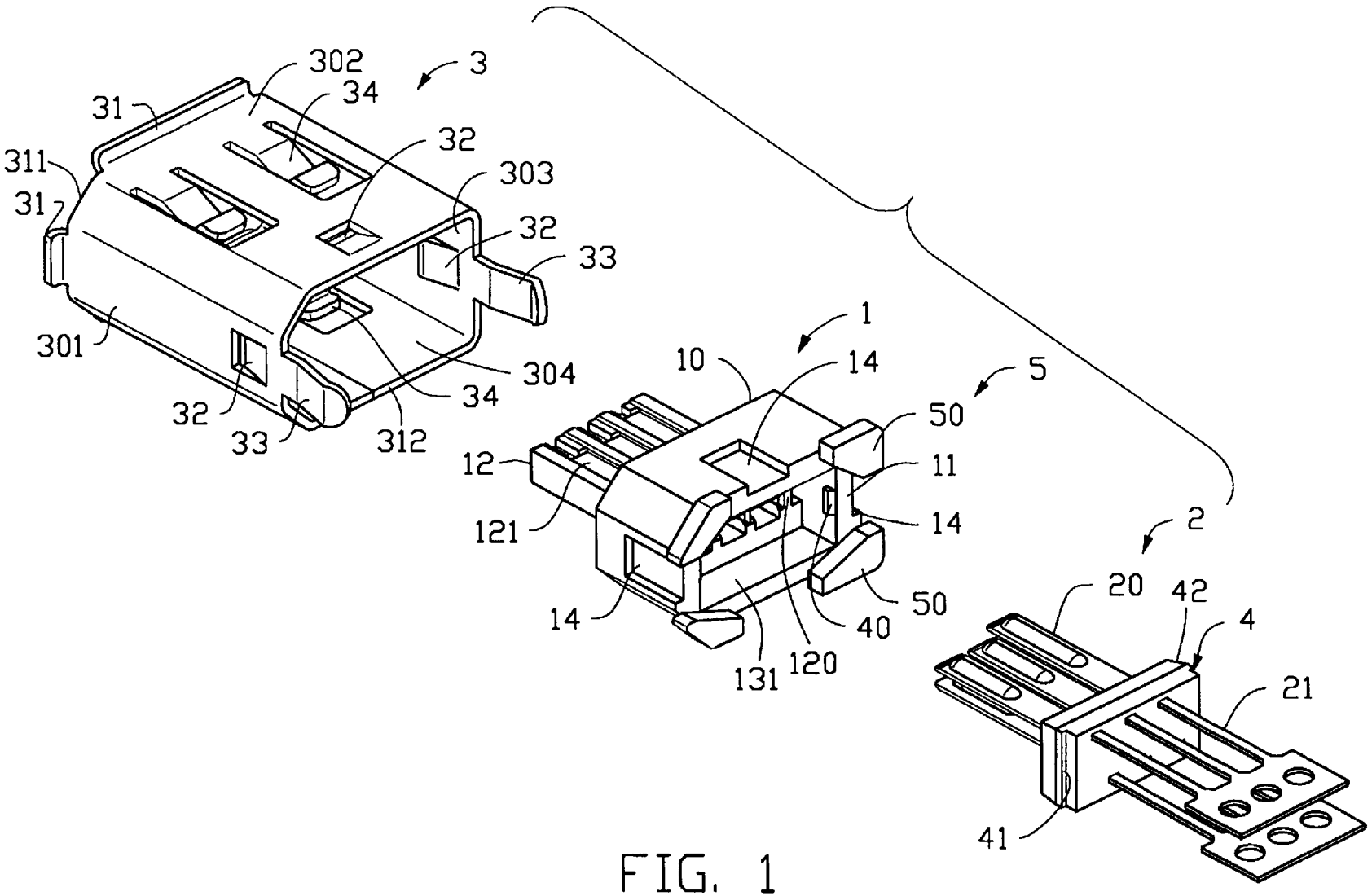
FIG. 1 is an exploded view of an electrical connector in accordance with the present invention.
Figure 2:
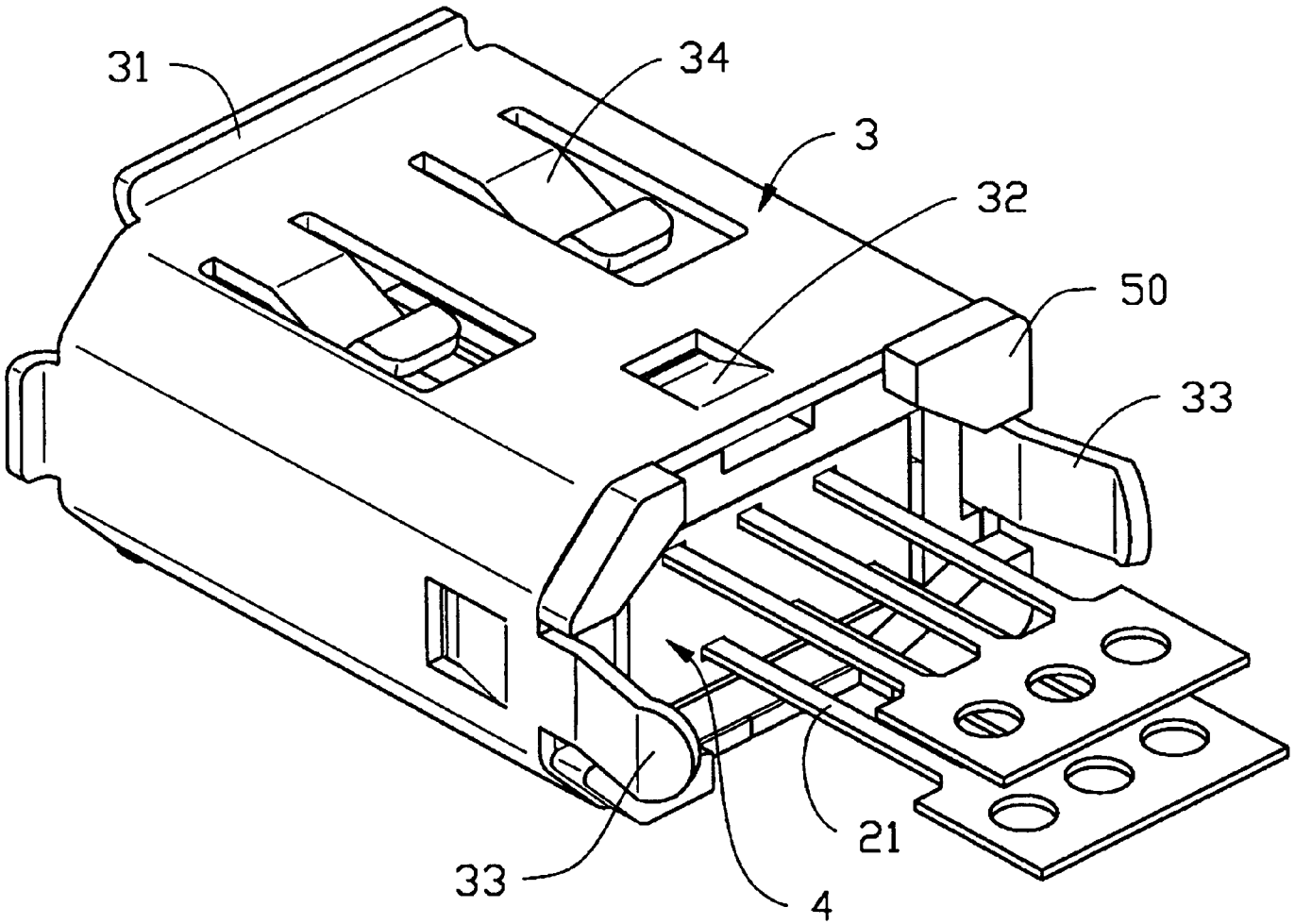
FIG. 2 is an assembled view of FIG. 1.

Referring to FIGS. 1 and 2, an electrical connector in accordance with a first embodiment of the present invention comprises an insulative housing 1 for receiving a plurality of contacts 2, stand-off means extending from the housing 1, a metallic shielding 3 having a closure shape for enclosing the housing 1, and a positioning device 4 received in the housing 1. In this embodiment, the contacts 2 are retained in the positioning device 4 by an insert molding procedure. Each contact 2 has a contacting portion 20 and a soldering tail 21 respectively extending from opposite sides of the positioning device 4.

The housing 1 has a mating face 10 and a soldering face 11 opposite the mating face 10. An intermediate plate 12 is integrated with the housing 1 by ribs 120 formed at opposite sides thereof. A plurality of passageways 121 are defined in opposite sides of the intermediate plate 12 for retaining contacts 2 therein. A reception space 131 is defined in the housing 1 internal to the soldering face 11 for receiving the positioning device 4. Recesses 14 are defined in outer periphery of the housing 1 for engaging with the shielding 3 when the latter encloses the housing 1. The stand-off means 5 comprises four blocks 50 extending from four corners of the housing 1 at the soldering face 11 for rest of a peripheral edge of the shielding 3, thereby preventing the shield 3 from direct mounting on a printed circuit board (not shown). Two elastic tabs 40 extend from opposite inner walls of the housing 1 to the reception space 131 for engaging with the positioning device 4.

The positioning device 4 is substantially a rectangular board having stepped members 41 formed on opposite sides thereof for engaging with the elastic tabs 40 of the housing 1 when it is received in the reception space 131 of the housing 1. Specifically, the positioning device 4 has a tapering surface 42 in each stepped member 41 for facilitating the insertion thereof into the reception space 131 via wiping by the elastic tabs 40. The positioning device 4 is finally retained in the reception space 131 by sandwiched between a rear edge of the intermediate plate 12 and the elastic tabs 40. Simultaneously, the contacts 2 are fixed in place by the positioning device 4 and the passageways 121 which retain the contacting portions 20 of the contacts 2.

The shielding 3 is a metallic closure made by stamping and bending from a metallic plate and comprises a first wall 301, a second wall 302 connected to the first wall 301, a third wall 303 connected to the second wall 302, and a fourth wall 304 connected to the third wall 303. Four curved guiding edges 31 are formed in a first entrance 311 of the shielding 3 for facilitating insertion of a complementary connector (not shown) when the latter is plugged into the connector of the present invention. A second entrance 312 is defined opposite to the first entrance 311 allowing insertion of the housing 1 when the latter is configured with the shielding 3. One engaging tab 32 is formed in each of the four walls 301, 302, 303, and 304 for engaging with corresponding recess 14 of the housing 1 when the shielding 3 is configured with the housing 1. Two grounding tabs 34 are respectively formed in the second and fourth walls 302, 304 for engaging with grounding portion of the complementary connector in order to expand a grounding area between the two connectors. Two retaining tails 33 extend from opposite walls 301, 303 for engaging to a printed circuit board on which the connector is mounted. With the stand-off means 5, a rear edge of the shielding 3 which surrounds the second entrance will be spaced from a mounting surface of the printed circuit board thus preventing any sputtered solder from shortening any signal contact to ground.

Figure 3:
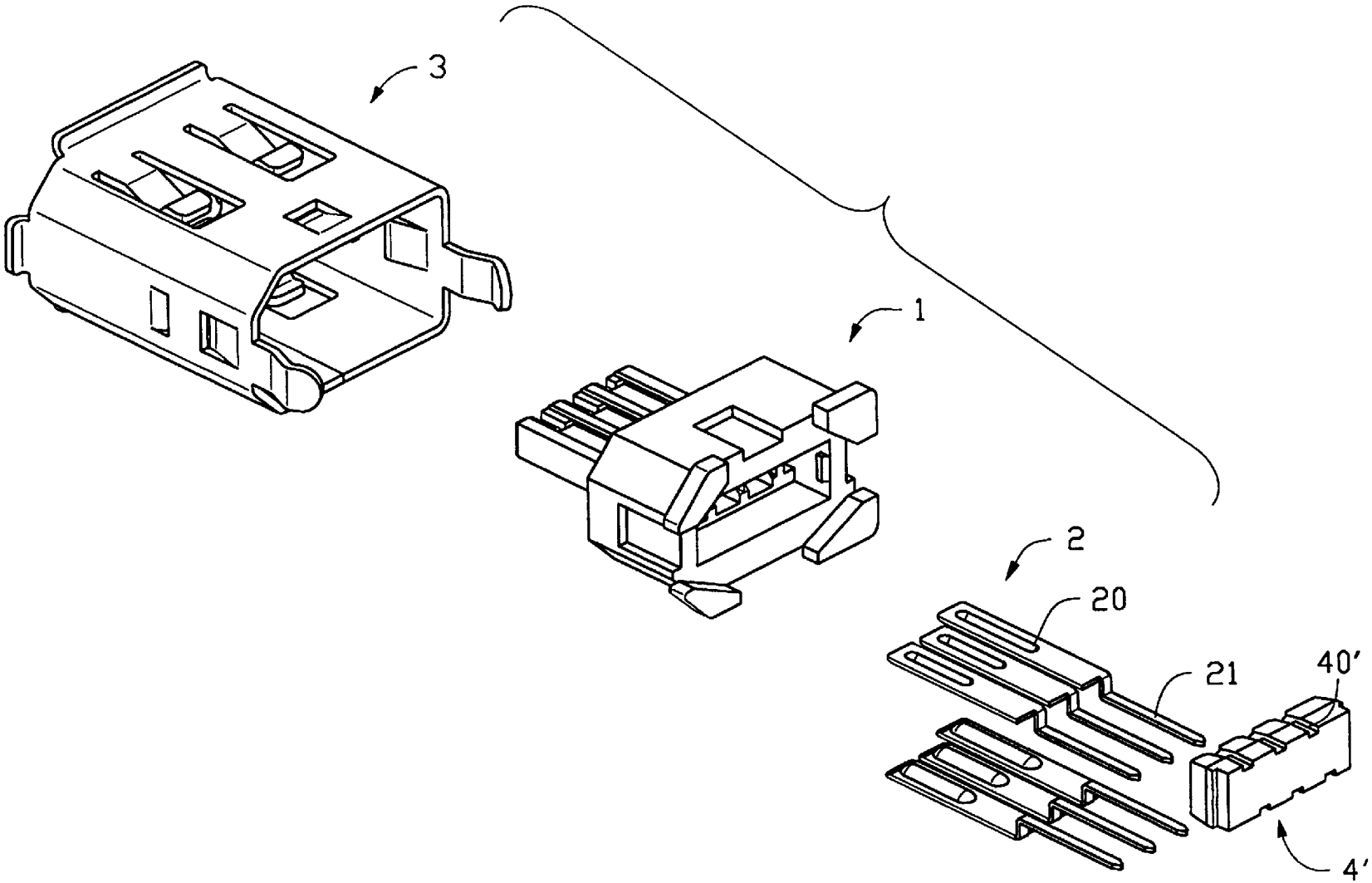
FIG. 3 is an exploded view of a second embodiment in accordance with the present invention.

Referring to FIG. 3, a second embodiment of the connector of the present invention is shown, wherein most parts thereof are identical to those described in the first embodiment, except that a positioning device 4' is not integrally connected to the contacts 2. The positioning device 4' defines a plurality of recesses 40' in opposite surfaces thereof for retaining the soldering tails 21 of the contacts 2. The change of the positioning device 4' does not affect the function thereof while the manufacturing cost thereof is considerably reduced compared to that of the first embodiment.

While the present invention has been described with reference to a specific embodiment, the description is illustrative of the invention and is not to be construed as limiting the invention.

Therefore, various modifications to the present invention can be made to the preferred embodiment by those skilled in the art without departing from the true spirit and scope of the invention as defined by the appended claims.

What is claimed is:

1. An electrical connector comprising:

a plurality of contacts each of which comprises a contacting portion and a soldering tail;

an insulative housing including an intermediate plate integrally formed with the insulative housing, the intermediate plate defining a plurality of passageways for respectively receiving the contacting portions of the contacts, and a soldering face formed on a wall of the housing and defining a reception space therewithin, the reception space being in communication with the passageways of the intermediate plates;

a positioning device attached to a section of each soldering tail of the contacts and pre-positioning the plurality of contacts therein, the positioning device together with the pre-positioned contacts being engageably received within the reception space of the housing through the soldering face so that a face of the positioning device is in contact with an edge of the intermediate plate in the reception space thereby ensuring the correct positioning of the contacts in the corresponding passageways; and a metallic shielding enclosing the insulative housing and defining two opposite entrances for communication of the housing outward of the shielding.

2. The electrical connector as claimed in claim 1, wherein the connection between the positioning device and the contacts is performed by insert molding.

3. The electrical connector as claimed in claim 1, wherein the insulative housing further comprises stand-off means extending from a periphery edge thereof.

4. The electrical connector as claimed in claim 1, wherein the insulative housing comprises elastic tabs formed in opposite inner walls of the reception space thereof for cooperating with the intermediate plate to retain the positioning device in the insulative housing.

5. The electrical connector as claimed in claim 4, wherein the positioning device is a rectangular board having stepped members on opposite sides thereof for engaging with the elastic tabs of the insulative housing.

6. The electrical connectors as claimed in claim 5, wherein the stepped members of the positioning device each have a tapering surface for facilitating insertion into the insulative housing by wiping by the elastic tabs.

7. An electrical connector comprising:

a plurality of contacts each of which comprises a contacting portion and a soldering tail;

an insulative housing including an intermediate plate integrally formed with the insulative housing, the intermediate plate defining a plurality of passageways for respectively receiving the contacting portions of the contacts, and a soldering face formed on a wall of the housing and defining a reception space therewithin, the reception space being in communication with the passageways of the intermediate plates;

a positioning device defining a plurality of recesses at opposite sides thereof, the recesses each respectively retaining a section of each soldering tail of the contacts, the positioning device being engageably received within the reception space of the housing through the soldering face so that a face of the positioning device is in contact with an edge of the intermediate plate in the reception space thereby ensuring the correct positioning of the contacts in the corresponding passageways; and a metallic shielding enclosing the insulative housing and defining two opposite entrances allowing the housing and the contacts to communicate outward of the shielding.

8. The electrical connector as claimed in claim 7, wherein the insulative housing further comprises stand-off means extending from a periphery edge thereof.

9. The electrical connector as claimed in claim 7, wherein the insulative housing comprises elastic tabs formed in opposite inner walls thereof for cooperating with the intermediate plate to retain the positioning device in the insulative housing.

10. The electrical connector as claimed in claim 9, wherein the positioning device has a rectangular shape and includes stepped members on opposite sides thereof for engaging with the elastic tabs of the insulative housing.

11. The electrical connector as claimed in claim 10, wherein the stepped members of the positioning device each has a tapering surface for facilitating insertion into the insulative housing by wiping by the elastic tabs.

* * * * *